US007850504B2

(12) United States Patent
Goldberg et al.

(10) Patent No.: US 7,850,504 B2
(45) Date of Patent: Dec. 14, 2010

(54) STIMULATING FEEDING DEVICE FOR A CHILD

(76) Inventors: Steven B. Goldberg, 8836 N. Kostner Terr., Skokie, IL (US) 60076; Jonathan David Friedman, 2101 E. Ter., Seattle, WA (US) 98122

( * ) Notice: Subject to any disclaimer, the term of this patent is extended or adjusted under 35 U.S.C. 154(b) by 146 days.

(21) Appl. No.: 12/037,155

(22) Filed: Feb. 26, 2008

(65) Prior Publication Data

US 2008/0203049 A1 Aug. 28, 2008

Related U.S. Application Data

(60) Provisional application No. 60/891,560, filed on Feb. 26, 2007.

(51) Int. Cl.
*A63H 3/00* (2006.01)

(52) U.S. Cl. ..... 446/74; 446/71; 446/73; 446/81; 446/404

(58) Field of Classification Search ..... 446/71, 446/73, 74, 77, 81, 404; 215/11.1
See application file for complete search history.

(56) References Cited

U.S. PATENT DOCUMENTS

| | | | | |
|---|---|---|---|---|
| 4,554,919 | A | 11/1985 | Hubert | |
| 4,678,093 | A | 7/1987 | Allen | |
| 4,817,153 | A * | 3/1989 | Fernandez | 381/26 |
| 4,898,060 | A * | 2/1990 | To | 84/95.2 |
| 5,189,389 | A * | 2/1993 | DeLuca et al. | 340/7.58 |
| 5,292,335 | A | 3/1994 | Shin | |
| 5,344,034 | A | 9/1994 | Eagan | |
| 5,518,405 | A | 5/1996 | Aiello | |
| 5,662,406 | A * | 9/1997 | Mattice et al. | 362/101 |
| 5,685,029 | A | 11/1997 | Gee | |
| 5,823,329 | A | 10/1998 | Roberts | |
| 5,842,901 | A | 12/1998 | Montgomery | |
| 5,966,814 | A | 10/1999 | Lin | |
| 5,978,976 | A | 11/1999 | Chai | |
| 6,024,625 | A | 2/2000 | Pearce | |
| 6,037,871 | A | 3/2000 | Babylon | |
| 6,135,606 | A | 10/2000 | Fernandez et al. | |
| 6,158,870 | A | 12/2000 | Ramirez | |
| 6,186,637 | B1 * | 2/2001 | Murrietta | 362/101 |
| 6,352,258 | B1 | 3/2002 | Fitzgerald et al. | |
| 6,413,137 | B1 | 7/2002 | Myers, Sr. | |
| 6,652,346 | B1 | 11/2003 | Arnold, III | |
| 6,698,036 | B2 | 3/2004 | Armbruster et al. | |
| 6,872,116 | B1 | 3/2005 | Dunnum et al. | |
| 6,945,664 | B1 * | 9/2005 | Frieling et al. | 362/101 |
| 7,134,932 | B1 * | 11/2006 | Carrasco et al. | 446/227 |
| 2002/0077018 | A1 | 6/2002 | Rice | |

(Continued)

FOREIGN PATENT DOCUMENTS

| | | |
|---|---|---|
| GB | 2240723 | 8/1991 |

*Primary Examiner*—Gene Kim
*Assistant Examiner*—Joseph B Baldori
(74) *Attorney, Agent, or Firm*—Carlson Gaskey & Olds PC

(57) ABSTRACT

An example feeding device includes a container and a controller that determines an orientation of the container. The controller activates a first stimulus when the container is in a first orientation and a second stimulus when the container is in another orientation. The first stimulus may please a child, and the second stimulus may displease a child.

12 Claims, 2 Drawing Sheets

U.S. PATENT DOCUMENTS

2003/0024840 A1 2/2003 Austin et al.
2003/0066126 A1 4/2003 Armbruster et al.
2003/0090892 A1* 5/2003 Su ..... 362/101
2003/0173491 A1 9/2003 Ibguy
2004/0117901 A1 6/2004 Armbruster et al.

* cited by examiner

STIMULATING FEEDING DEVICE FOR A CHILD

CROSS REFERENCE TO RELATED APPLICATIONS

This application claims priority to U.S. Provisional Application No. 60/891,560, filed on 26 Feb. 2007 and incorporated herein by reference.

BACKGROUND

This invention relates to a feeding device that produces different stimuli depending on an orientation of the feeding device.

Baby bottles, sippy-cups, and similar child feeding devices are well known. Bottles typically include a cup-like container for holding a liquid, such as milk, juice, or water. A screw-on cap attaches to an open end of the container to prevent spilling the liquid. The cap includes a nipple with a hole, which allows a child to drink the liquid by sucking on the nipple. Some bottles include a weighted base portion to discourage tipping the bottle.

Pointing the nipple of a bottle or the spout of a sippy-cup down facilitates liquid flow from the bottle. Accordingly, bottles are commonly held in this position when feeding a child. Often a person feeding the child holds the bottle at an oblique angle so that the nipple points down. As the child grows, the child can eventually hold the bottle in this position. Some bottle designs include handles or grips that provide handholds for the child or person feeding the child to grasp the bottle.

Children often refuse to feed, thus some bottles initiate pleasing stimuli, such as entertaining lights, soothing music, or both, to encourage feeding. Once the child associates the act of feeding with the pleasing stimuli, the child desires to start or continue feeding. Some bottles initiate the pleasing stimuli when the bottle is held in a certain position. These bottles include only one type of stimuli, which limits the stimulating experiences available for the child.

SUMMARY

An example feeding device includes a container and a controller that determines an orientation of the container. The controller activates a first stimulus when the container is in a first orientation and a second stimulus when the container is in another orientation. The first stimulus and the second stimulus may please a child. The first stimulus is typically more pleasing than the second stimulus.

One example feeding device includes a container and a sensor for determining a spatial orientation of the container. A controller activates a first stimulus when the spatial orientation of the container corresponds to a feeding position. The controller activates a second stimulus when the spatial orientation of the container corresponds to a nonfeeding position.

An example method of encouraging feeding includes providing a feeding device movable between a feeding orientation and a nonfeeding orientation. The method activates a first stimulus when the feeding device is in the feeding orientation and activates a second stimulus when the feeding device is in the second orientation.

The various features and advantages of this invention will become apparent to those skilled in the art from the following detailed description. The drawings that accompany the detailed description can be briefly described as follows.

DETAILED DESCRIPTION

Figure 1:
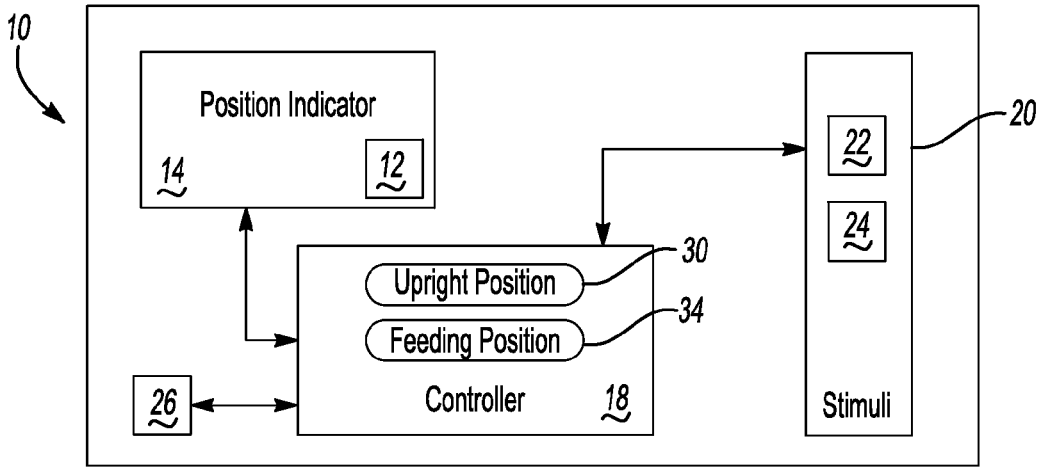
FIG. 1 shows a schematic of an example feeding device.

FIG. 1 schematically shows selected portions of a feeding device 10, including a position indicator 14, a controller 18, and a group of stimuli sources 20. A baby bottle is one example feeding device 10. Another example is a sippy-cup. The position indicator 14 includes a sensor 12 that provides information to the controller 18 for determining the spatial orientation of the feeding device 10. Depending on the orientation, the controller 18 initiates a first stimulus 22 source or a second stimulus source 24 from the group of stimuli sources 20. The stimuli provided by the sources 20 include a visual stimulus, an audible stimulus, a tactile stimulus, or a combination of them.

An adjustment mechanism 26 establishes parameters for the respective spatial orientations corresponding to a generally or nonfeeding upright position 30 and a feeding position 34. The controller 18 utilizes spatial orientation information from the position indicator 14 and the parameters from the adjustment mechanism 26 to determine if the feeding device 10 is in the upright position 30 or the feeding position 34. The example controller 18 initiates the first stimulus 22 in one of the positions and the second stimulus 24 in the other position.

Figure 2:
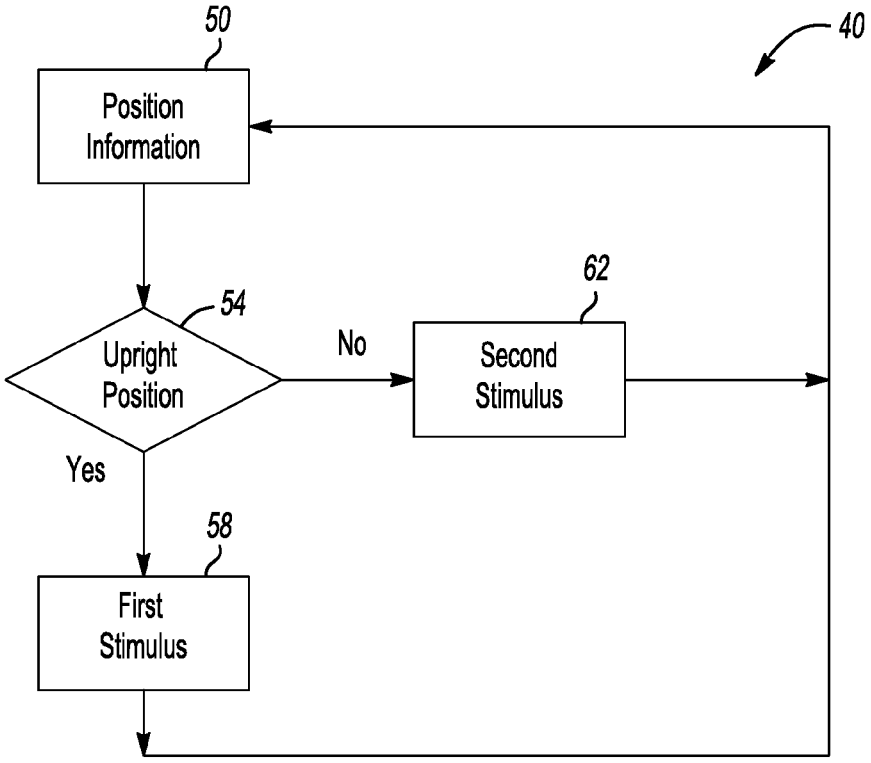
FIG. 2 is a flow chart showing an example decision by the FIG. 1 control strategy.

FIG. 2 shows an example control strategy 40 used by 18. The example controller to determine whether to initiate the first stimulus 22 or the second stimulus 24. At 50, the position indicator 14 sends spatial orientation information about the feeding device 10 to the controller 18, which then determines whether the spatial orientation information corresponds to the generally upright nonfeeding device position at 54. If the spatial orientation corresponds to the upright nonfeeding position at 54, the controller 18 initiates the first stimulus 22 at 58. If the spatial orientation information does not correspond to an upright, nonfeeding position at 54, the controller 18 determines that the device is in an at least partially inverted, feeding position and initiates the second stimulus 24 at 62.

After initiating the first stimulus 22 or the second stimulus 24, the controller 18 receives additional spatial orientation information at 50. If the spatial orientation information changes, the controller 18 changes the stimulus accordingly. In this example, the controller 18 continually monitors the feeding device position at 50 to ensure that changes from or to the upright feeding device position changes between the first stimulus 22 and the second stimulus 24 correspond to changes between the generally upright and at least partially inverted positions.

Although described as singular, the first stimulus 22 may contain more than one stimulus (e.g., lights and sound). Similarly, the second stimulus 24 may contain more than one stimulus (e.g., vibration and sound).

Figure 3A:
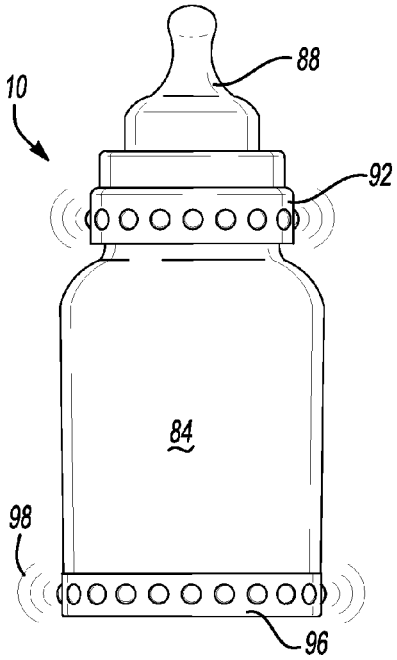
FIG. 3A illustrates, an example, in an upright position.
Figure 3B:
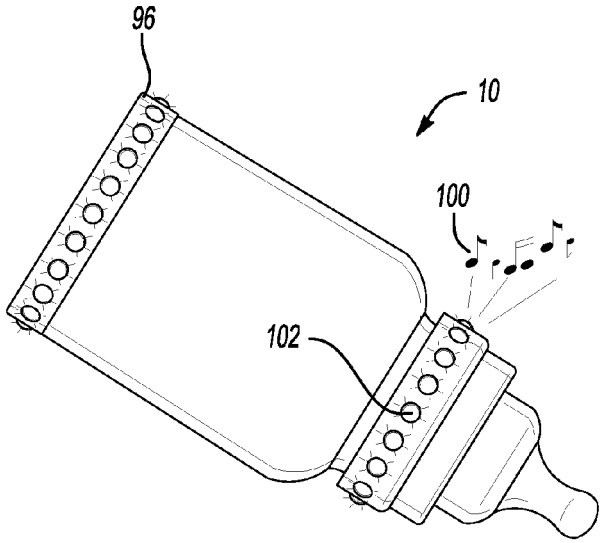
FIG. 3B illustrates the FIG. 3A bottle in a feeding position.

Referring now to FIGS. 3A and 3B, an example baby bottle type feeding device 10 includes a container portion 84, a nipple portion 88, and two collar assemblies 92 and 96. In this example, the collar portions 92 and 96 include lights 94 that are sources of visual stimuli. This example also includes a sound generator as a source of auditory stimuli such as music or other sounds. The illustrated example also includes a vibrating mechanism as a source of tactile stimuli such as vibrations. Known devices for generating such stimuli may be incorporated into the example collar portions 92 and 96.

In this example, when the feeding device 10 is in an upright position of FIG. 3A, the controller 18, which is supported by or in one of the collar portions 92 and 96, initiates the first stimulus 22. In this example, the first stimulus 22 includes vibrations for example, schematically shown at 98 perceivable by the child. At least one of the example collars 92 or 96 includes a device for producing the vibrations 98.

When the feeding device 10 moves from the generally upright position to another position, such as the at least partially inverted feeding position shown in FIG. 3B, the controller 18 stops the first stimulus and initiates the second stimulus. In this example the vibrations 98 (i.e., the first stimulus) stop and pleasing music 100 and flashing lights 102 (i.e., the second stimulus) begin. If the feeding device 10 moves back to the upright position, the pleasing music 100 and flashing lights 102 stop and the vibrations 98 begin. Some examples may include stimulus only in the base portion collar 96 to reduce cost or keep a battery powering the stimulus away from the child. Such examples would also increase visibility as the flashing lights 102 are further from the child's eyes.

In time, a child associates moving the feeding device 10 from the upright position with stopping the vibrations 98. In this example, the vibrations 98 are displeasing to a child (i.e., the vibrations 98 are less pleasing to the child than the pleasing music 100 and flashing lights 102). Accordingly, the child is discouraged from maintaining the feeding device 10 in the upright position. In addition, the pleasing music 100 and flashing lights 102 play when the feeding device 10 is in the feeding position, but not when the feeding device is in the upright position. In this example, the child enjoys the pleasing music 100 and flashing lights 102. This reinforces holding the feeding device in the feeding position. In other words, the example first stimulus encourages a child to move the feeding device 10 into a feeding position and the example second stimulus encourages maintaining the feeding device 10 in the feeding position.

Stimuli other than vibrations, lights, and music may be used. In another example, the feeding device 10 incorporates visual stimulations that move (e.g., a spinning collar). Further, some vibrations encourage the child to move to a position suitable for feeding and encourage the child to open their mouth or otherwise move their mouth to a position suitable for feeding. Such child-pleasing vibrations are used when the feeding device 10 is in the inverted feeding position of FIG. 3B.

Figure 4:
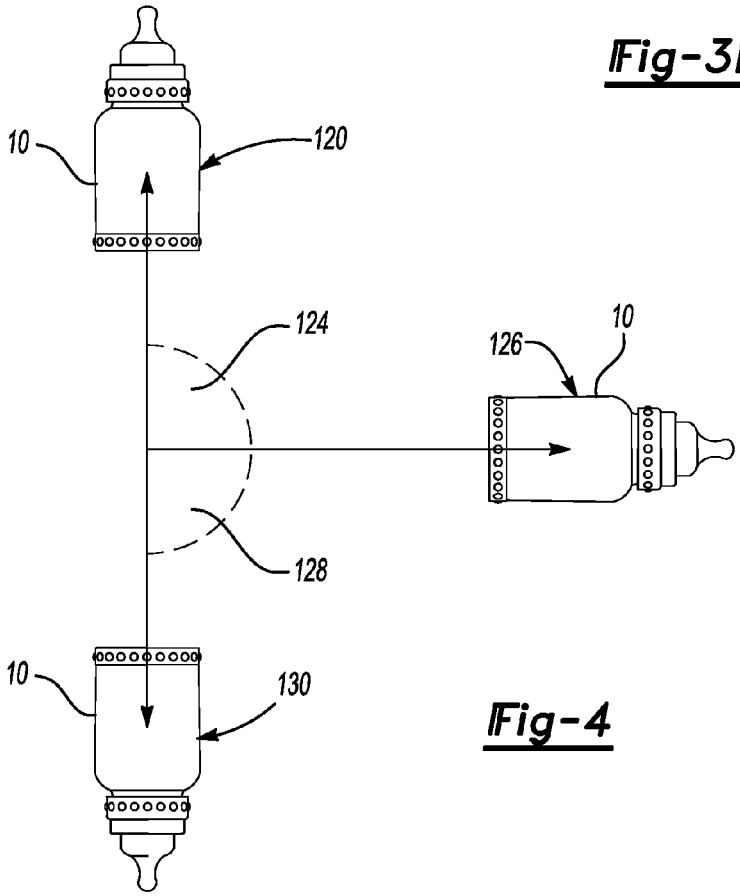
FIG. 4 illustrates example spatial orientations corresponding to an upright position and a feeding position for the FIG. 3A and 3B bottle.

Referring now to FIG. 4, the feeding device 10 rotates though a range of angles 124 as the feeding device 10 tilts away from an upright, vertical position 120 to a horizontal position 126. The controller 18 may associate the range of angles 124 with the position and, as a result, initiate the first stimulus 22. The first stimulus 22 in this example discourages the child from maintaining these positions. As the feeding device 10 moves further away from the upright, vertical position 120 the feeding device 10 moves through a second range of angles 128 between the horizontal position 126 and an inverted position 130. The positions within the range of angles 128 are considered feeding positions 34 in this example. When in these positions, the controller 18 initiates the second stimulus 24, which encourages the child to maintain the feeding device 10 in these positions.

In this example, the sensor 12 determines the spatial orientation of the feeding device 10. The sensor 12 measures the angle of the feeding device 10 to determine the spatial orientation of the feeding device 10. The controller 18 associates the angular measurements with the ranges 124 or 128 to determine whether the device 10 is a feeding position, for example.

A worker of ordinary skill in this art would recognize that certain modifications of the disclosed embodiment are possible that would come within the scope of this invention. For that reason, the following claims should be studied to determine the true scope and content of this invention.

We claim:

1. A feeding device comprising:
- a container having a feeding spout;
- a sensor for determining a spatial orientation of said container;
- a first device that provides a first stimulus;
- a second device that provides a second stimulus; and
- a controller configured to activate said first device to provide the first stimulus when the spatial orientation of said container corresponds to a feeding position and configured to activate said second device to provide the second stimulus when a spatial orientation of said container corresponds to a nonfeeding position.

2. The feeding device of claim 1, wherein the first stimulus or the second stimulus is visual.

3. The feeding device of claim 1, wherein the first stimulus or the second stimulus is audible.

4. The feeding device of claim 1, wherein the first stimulus or the second stimulus is tactile.

5. The feeding device of claim 1, wherein said container comprises at least one collar assembly supporting the at least one stimulus device.

6. The feeding device of claim 1, wherein the first and second stimulus devices include
- (i) a light that is activated to provide the first stimulus to please a child and
- (ii) a vibrating device that is activated to provide the second stimulus to encourage the child to maintain the container in an orientation associated with the first stimulus.

7. The feeding device of claim 1, wherein the feeding position comprises an at least partially inverted position of said container.

8. The feeding device of claim 1, wherein the nonfeeding position comprises a generally upright position of said container.

9. The feeding device of claim 1, wherein said sensor determines an angle of said container.

10. The feeding device of claim 9, wherein a first range of angles corresponds to the feeding position of said container and a second range of angles corresponds to the nonfeeding position.

11. The feeding device of claim 1, wherein the second stimulus comprises a vibrating device that generates vibrations that are displeasing to the child relative to the first stimulus.

12. A feeding device comprising:
- a container having a feeding spout;
- a sensor for determining a spatial orientation of said container;
- a first device that provides a first stimulus;
- a second device that provides a second stimulus; and
- a controller configured to activate said first device to provide the first stimulus when the spatial orientation of said container corresponds to a feeding position, said controller further configured to deactivate said first device to deactivate the first stimulus to activate said second device to provide and a second stimulus when a spatial orientation of said container corresponds to a nonfeeding position.

* * * * *